US008998480B2

(12) United States Patent
Dellian et al.

(10) Patent No.: US 8,998,480 B2
(45) Date of Patent: Apr. 7, 2015

(54) LED LIGHTING DEVICE

(75) Inventors: Harald Dellian, Edling (DE); Stefan Otzen, München (DE)

(73) Assignee: OSRAM GmbH, Munich (DE)

( * ) Notice: Subject to any disclaimer, the term of this patent is extended or adjusted under 35 U.S.C. 154(b) by 220 days.

(21) Appl. No.: 13/636,092

(22) PCT Filed: Mar. 7, 2011

(86) PCT No.: PCT/EP2011/053375

§ 371 (c)(1), (2), (4) Date: Sep. 19, 2012

(87) PCT Pub. No.: WO2011/113717

PCT Pub. Date: Sep. 22, 2011

(65) Prior Publication Data

US 2013/0010473 A1 Jan. 10, 2013

(30) Foreign Application Priority Data

Mar. 19, 2010 (DE) ..... 10 2010 003 073

(51) Int. Cl.

| | |
|---|---|
| ***F21V 17/00*** | (2006.01) |
| ***F21V 19/00*** | (2006.01) |
| ***F21V 15/01*** | (2006.01) |
| ***F21V 17/16*** | (2006.01) |
| *F21S 4/00* | (2006.01) |
| *F21Y 101/02* | (2006.01) |

(52) U.S. Cl.

CPC ..... *F21V 19/004* (2013.01); *F21V 15/013* (2013.01); *F21V 17/16* (2013.01); *F21S 4/003* (2013.01); *F21Y 2101/02* (2013.01)

(58) Field of Classification Search

CPC ..... F21S 4/008; F21S 4/003; F21V 17/104; F21V 17/164; F21V 19/0015; F21V 19/002; F21V 19/004; F21V 19/0045

USPC ..... 362/632, 634, 646, 648, 652, 655, 656

See application file for complete search history.

(56) References Cited

U.S. PATENT DOCUMENTS

| | | | | |
|---|---|---|---|---|
| 2002/0093092 | A1 | 7/2002 | Kanelis | |
| 2007/0109751 | A1* | 5/2007 | Mayer et al. | 361/719 |
| 2007/0211481 | A1 | 9/2007 | Cooper et al. | |
| 2009/0135597 | A1 | 5/2009 | Kay | |
| 2009/0146561 | A1* | 6/2009 | Jiang | 313/512 |
| 2009/0213595 | A1 | 8/2009 | Alexaner | |
| 2009/0244909 | A1 | 10/2009 | Chen | |
| 2013/0258668 | A1* | 10/2013 | Dellian et al. | 362/249.02 |

FOREIGN PATENT DOCUMENTS

| | | |
|---|---|---|
| DE | 196 38 863 | 4/1998 |
| DE | 299 19 897 | 5/2000 |
| DE | 101 15 846 | 10/2001 |
| DE | 103 06 720 | 8/2004 |
| DE | 10 2006 021 973 | 11/2007 |
| DE | 20 2008 011 979 | 12/2008 |

(Continued)

*Primary Examiner* — Sharon Payne
*Assistant Examiner* — Kenny C Sokolowski
(74) *Attorney, Agent, or Firm* — Cozen O'Connor

(57) ABSTRACT

An LED lighting device, in particular an LED retrofit lamp, comprising a light-emitting means (2) having at least one LED (16) and a lampholder (1) for accommodating the light-emitting means (2), and at least one elastic element (12), which braces the light-emitting means (2) in the lampholder.

8 Claims, 5 Drawing Sheets

(56) References Cited

FOREIGN PATENT DOCUMENTS

| | | |
|---|---|---|
| DE | 20 2010 005 681 | 9/2010 |
| EP | 1 813 857 | 1/2006 |
| EP | 2 284 440 | 2/2011 |
| JP | 2004-186105 | 7/2004 |
| WO | WO 2007/128070 | 11/2007 |
| WO | WO 2011/015168 | 2/2011 |

* cited by examiner

LED LIGHTING DEVICE

RELATED APPLICATIONS

This is a U.S. National Phase Application under 35 USC 371 of International Application PCT/EP2011/0533375 filed on Mar. 7, 2011.

This application claims the priority of German Application No. 10 2010 003 073.2 filed Mar. 19, 2010, the content of which is hereby incorporated by reference.

FIELD OF THE INVENTION

The present invention relates to an LED lighting device with a replaceable lampholder and, in particular, to an LED retrofit lamp.

BACKROUND OF THE INVENTION

The continuously increasing costs of energy and the demand for environmentally sustainable light-emitting means have accelerated the development of LED technology to a considerable extent, in particular in recent history. The most efficient white LEDs therefore at present already achieve a luminous efficacy of up to 120 lumens/watt. The life of commercially available LED light-emitting means with an incandescent lamp form, for example, can also now already reach above 25 000 hours. It is therefore conceivable that the range of uses for LEDs will increase in the future and probably also present light-emitting means such as conventional incandescent lamps, halogen lamps or the like will be replaced to a large extent by LEDs.

However, one difficulty with the use of LEDs consists in that in conventional use they are subject to a specific aging process depending on the power consumed and the temperature, with the result that LED lighting devices also need to be replaced from time to time by untrained personnel. Furthermore, an increase in the efficiency and performance can be assumed. Only this replacement possibility which can be implemented by a non-technician makes the commercial use of LED lighting devices possible for the first time, in particular in the domestic sector.

The prior art has therefore disclosed LED lighting devices comprising a light-emitting means having a plurality of LEDs and a light-emitting means lampholder, into which the light-emitting means is pressed firmly. In this case, the lampholder is generally provided with a bayonet connection or a screw thread, with the result that the light-emitting means can be screwed as conventional incandescent lamps are into known incandescent lamp lampholders. LED lighting devices which can be used instead of conventional incandescent or discharge lamps owing to their dimensions, shape and electrical and/or mechanical connection possibilities are referred to as LED lamps or LED retrofit lamps.

If the LEDs now lose luminescent intensity as the life increases, the LED lighting device, in the same way as a conventional incandescent bulb or a conventional halogen lamp, can be unscrewed from the incandescent lamp lampholder and replaced by a new LED lighting device. However, the problem here consists in that in particular the lampholders accommodating the light-emitting means of the LED lighting device are complex in terms of manufacture and therefore contribute considerably to an increase in cost of the LED lighting device. This makes the LED lighting device in the present form economically unattractive.

SUMMARY OF THE INVENTION

One object of the present invention is to provide an LED lighting device, in particular an LED retrofit lamp, which has improved functionality. Another object of the invention is to improve the efficiency of the LED lighting device.

One embodiment of the invention is directed to an LED lighting device comprising a light-emitting means having at least one LED and a lampholder for accommodating the light-emitting means. Furthermore, at least one elastic element, for example a spring element, is provided, which clamps the light-emitting means in the lampholder. That is to say that, in contrast to the known prior art, the light-emitting means is not pressed undetachably into the lampholder, for example a reflector, but the light-emitting means is inserted detachably and therefore replaceably into the lampholder, for example the reflector, and is held therein in spring-elastic fashion. If, therefore, a replacement of the LEDs is required owing to the dwindling luminous efficacy thereof, it is not necessary for the entire LED lighting device including the lampholder to be disposed of, but rather in the future only the light-emitting means itself needs to be replaced by a new light-emitting means, which can be clamped into the old lampholder. This considerably reduces the maintenance costs of the LED lighting device and therefore overall the production costs thereof.

In an embodiment of the invention, the elastic element is in the form of a metal spring, which acts on the light-emitting means at the edge with a spring force. That is to say that the spring element exerts a spring force on the light-emitting means at least proportionally perpendicular to the light-emitting means emission direction and therefore pretensions said light-emitting means against an edge section, surrounding the light-emitting means, of the lampholder. In this way, the light emission properties of the light-emitting means in comparison with the conventional lamp design are maintained.

In accordance with a further aspect of the invention, a receptacle, preferably in the form of the elastic element, is formed in the lampholder, with the elastic element being inserted or positioned into said receptacle. This facilitates the removal and introduction of the light-emitting means out of/into the lampholder without the elastic element being moved or falling out. In this way, always the same clamp-in force and clamp-in direction on the light-emitting means is ensured.

In addition, the spring brings about a constant contact pressure, which is required for ensuring the heat dissipation between the light-emitting means and the lampholder.

BRIEF DESCRIPTION OF THE DRAWINGS

The invention will be explained in more detail below using two exemplary embodiments with reference to the attached figures, in which.

DETAILED DESCRIPTION OF THE DRAWINGS

Figure 1:
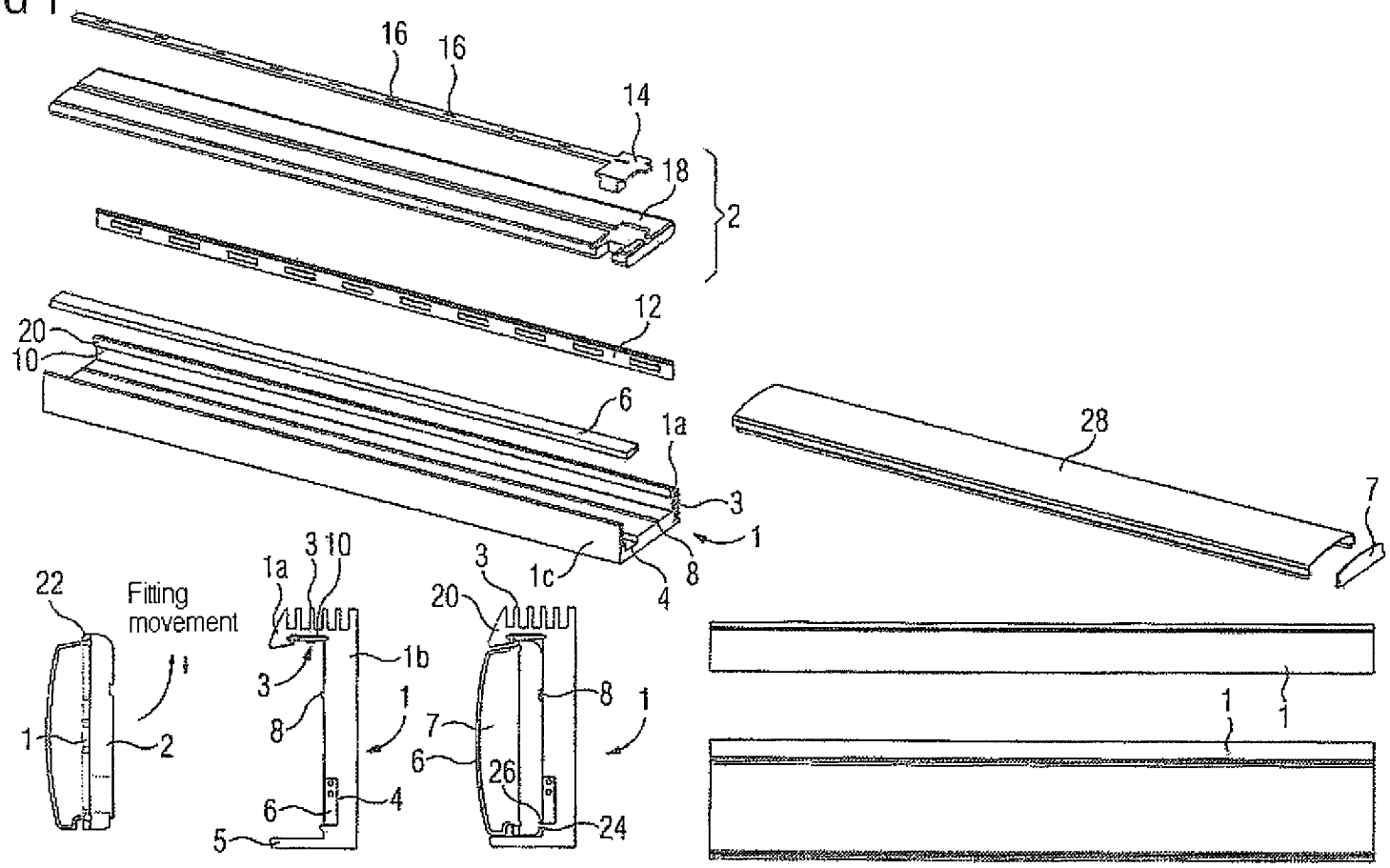
FIG. 1 shows an exploded illustration of an LED lighting device with a tubular form in accordance with a first preferred exemplary embodiment of the invention.

As shown in FIG. 1, the LED lighting device of the first preferred exemplary embodiment comprises a lampholder 1 and a light-emitting means 2 which can be inserted into the lampholder. The lampholder 1 is in this case in the form of a bar and has substantially a channel-shaped or U-shaped cross section. Specifically, the lampholder 1 forms an accommodating rail with a U profile, with cooling ribs 3 being formed on at least one side flank 1*a* of said accommodating rail, said cooling ribs extending in the longitudinal direction of the accommodating rail 1. The inner side of the rail base 1*b* has a groove 4 extending longitudinally, with an electrical terminal bus 6 being inserted into said groove, said terminal bus having jacks or plugs (not shown) for power supply. Furthermore, coding in the form of a projection and/or recess 8 is arranged or formed on the inner side of the rail base 1*b*, with the result that only a light-emitting means which is compatible with this projection or recess 8 can be inserted into the accommodating rail 1.

Figure 4:
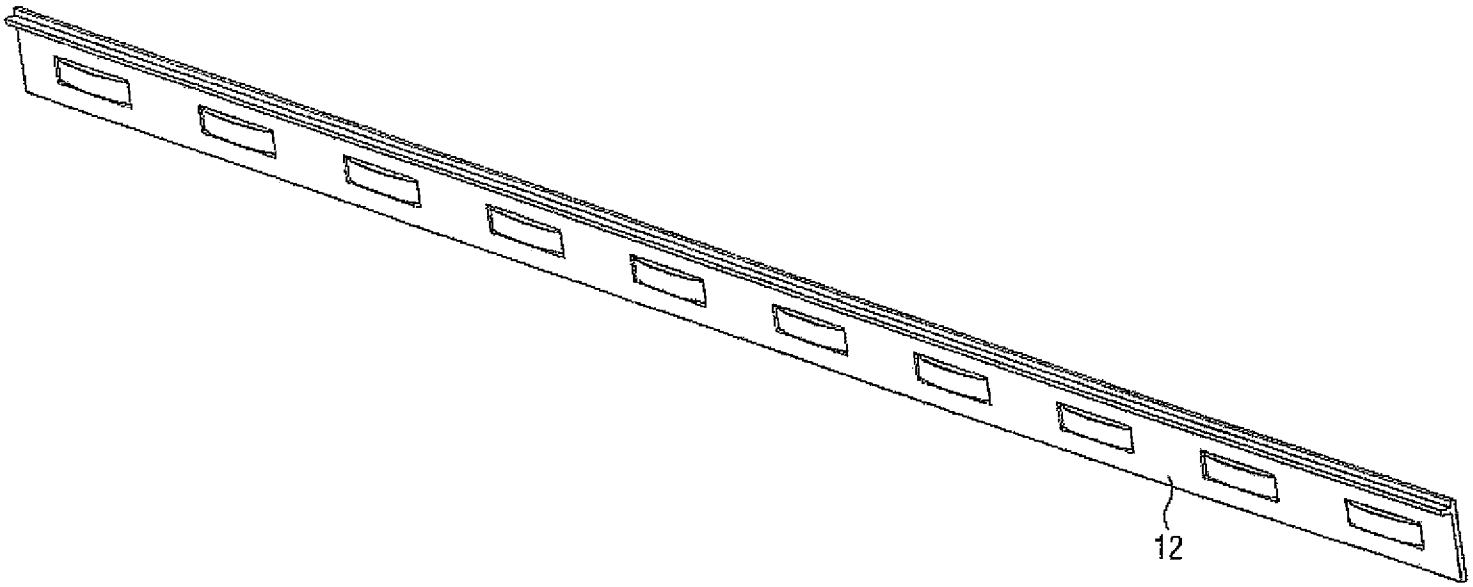
FIG. 4 shows the singular illustration of an elastic element as pretensioning element in accordance with a preferred embodiment, as is used in the first exemplary embodiment according to the invention.

Preferably, a further longitudinal groove 10 is formed in the side flank 1*a* of the accommodating rail 1 which has the cooling ribs 3, with an elastic element 12 being inserted into said longitudinal groove, as is illustrated by way of example in FIG. 4. Accordingly, the elastic element 12 comprises a metal or plastic rail, into which preferably rectangular cutouts (apertures) are formed which are spaced apart from one another in the longitudinal direction. Spring platelets are inserted into these openings in such a way that said spring platelets bulge out in the direction towards a flat side of the spring strip 12 and therefore define an elastically flexible overall surface. The strip element 12 is in this case inserted into the flank-side groove 10 and preferably fastened therein.

In accordance with the first preferred exemplary embodiment of the invention, the light-emitting means 2 comprises a bar-shaped or strip-shaped printed circuit board 14, onto which at least one, preferably a plurality of longitudinally spaced-apart LEDs 16 are soldered or plugged. Furthermore, the light-emitting element 2 has a mount 18 for the printed circuit board 14 in the form of a primary heat sink. Specifically, the mount 18 is formed from a thermally conductive material in the form of a strip or a bar and has a surface contour on one side such that the printed circuit board 14 can be pressed substantially in form-fitting fashion onto or into the mount 18. As a result, the mount 18 and the printed circuit board 14 are assembled to form a unit representing the light-emitting means 2.

The external dimensions (peripheral dimensions) of the mount 18 or primary heat sink are such that the primary heat sink or mount 18 can be inserted into the U-shaped accommodating rail 1 (lampholder).

Specifically, the width of the mount 18 is dimensioned such that, when the mount 18 is inserted, into the U-shaped accommodating rail 1, the strip-shaped elastic element 12 inserted therein is tensioned. In this way, the elastic element 12 exerts a pretensioning force on the light-emitting means 2 and in particular on the primary heat sink 18, said pretensioning force being directed transversely to the U-shaped profile, i.e. in the direction towards the opposite flank 1*c* of the accommodating rail 1. Accordingly, the heat sink 18 is clamped in in the transverse direction between the elastic element 12 and the opposite side flank 1*c* of the accommodating rail 1. The contact pressure is decisive for the cooling of the light-emitting means.

Figure 3:
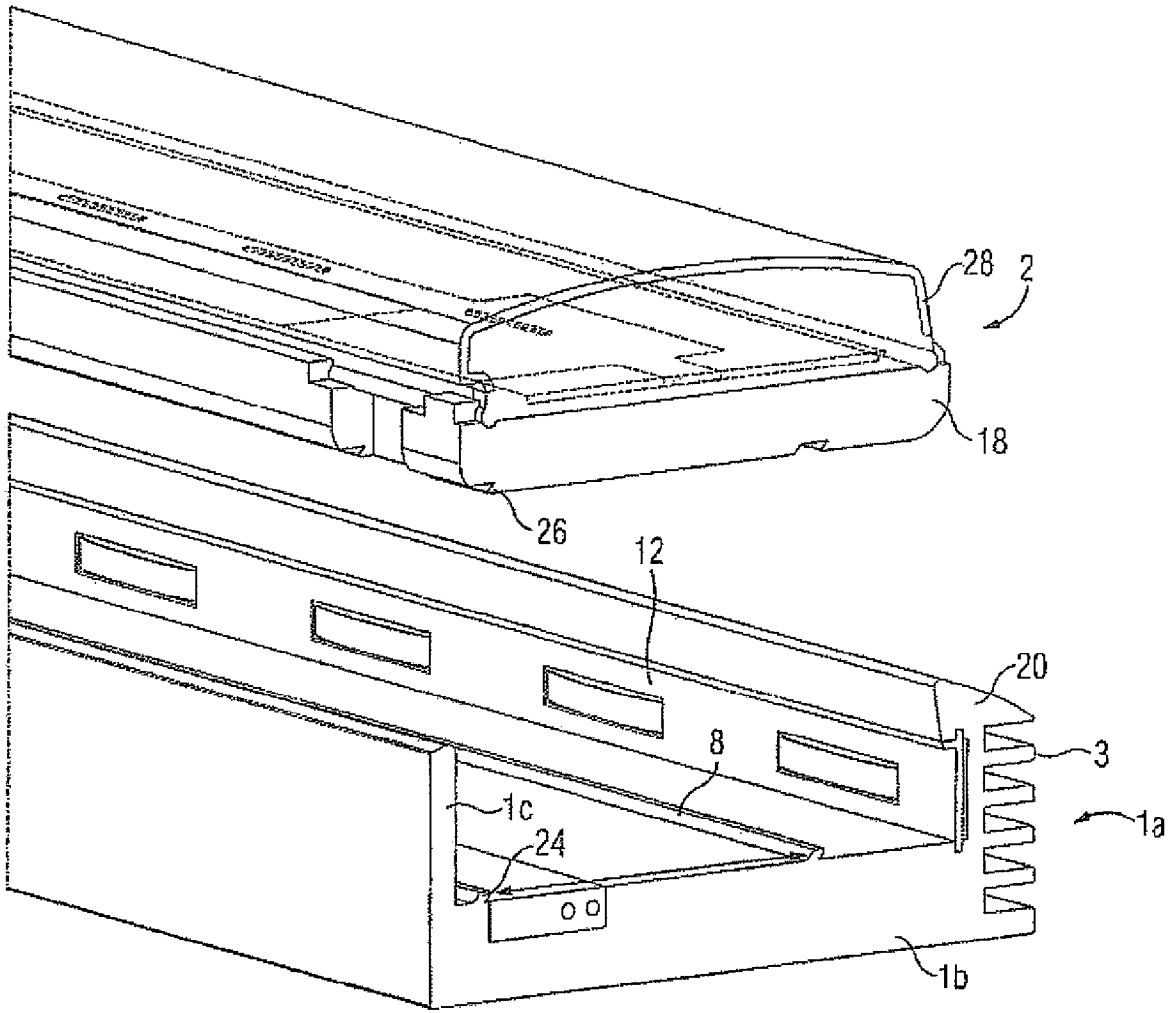
FIG. 3 shows an enlarged illustration of the light-emitting means and the lampholder of the LED lighting device of the first preferred exemplary embodiment.

As can also be seen from FIG. 1 and in particular from FIG. 3, the side flank 1*a* of the accommodating rail 1 which is provided with the cooling ribs 3 has, at its free edge, an inwardly directed projection 20, which forms a latching tab extending along the accommodating rail 1. In turn, the mount 18 or primary heat sink of the light-emitting means 2 has a lateral bearing edge 22, which extends along the primary heat sink 18. If the heat sink 18 is now inserted into the lampholder 1 or the U-shaped accommodating rail, not only does the elastic element 12 exert a laterally effective pretensioning force on the primary heat sink 1, but said primary heat sink latches additionally with the latching tab 20 on one side flank 1*a* of the accommodating rail 1. As a result, the position of the primary heat sink 18 in the accommodating rail 1 is secured.

Figure 2:
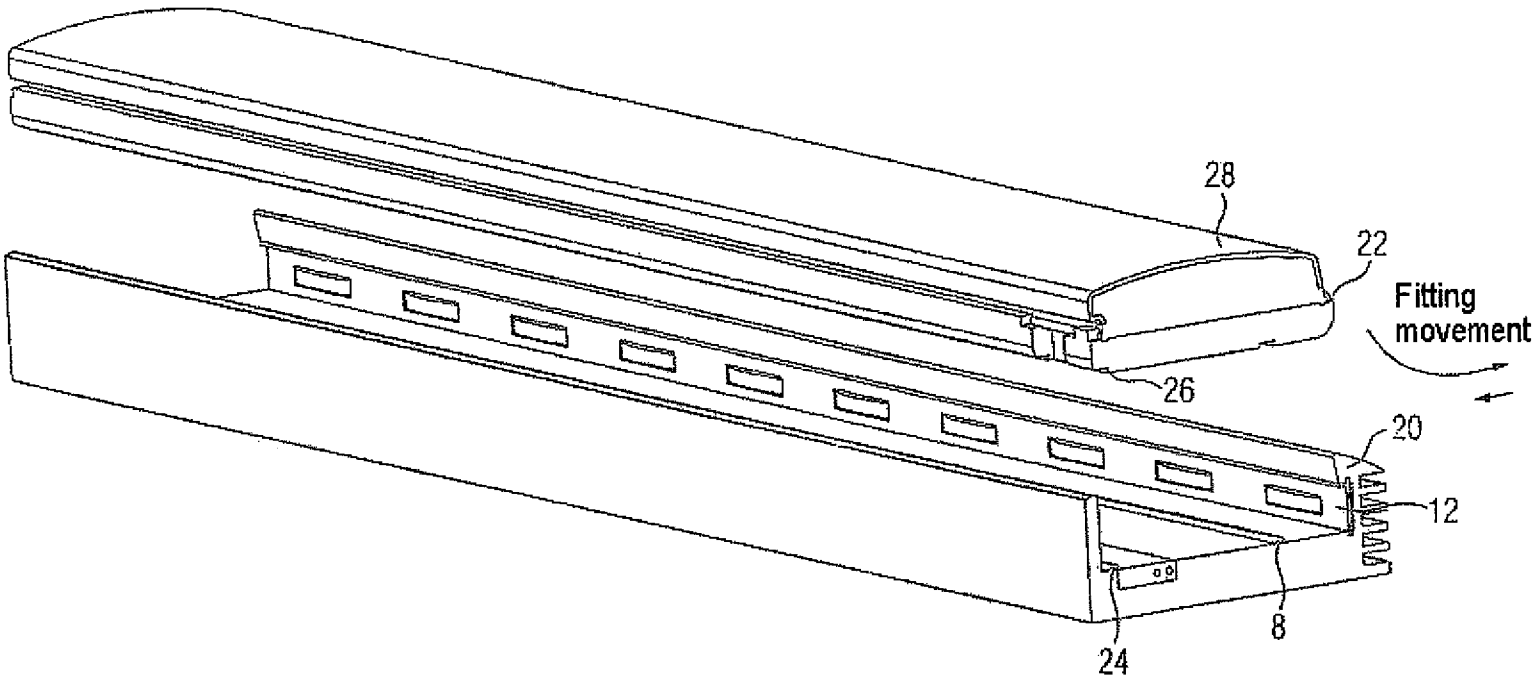
FIG. 2 shows the illustration of a fitting operation with respect to the LED lighting device of the first preferred exemplary embodiment.

In addition, a latching tab 24 is preferably formed in the rail base 1*b* on that side of the accommodating rail 1 which is opposite the side flank 1*a* with the heat sinks 3, which latching tab can be brought into latching engagement with an indentation 26 in the primary heat sink 18. The insertion of the light-emitting means 2 into the lampholder 1 is in this case represented illustratively in FIG. 2.

Accordingly, the primary heat sink 18 (mount), onto which the printed circuit board 14 including the LEDs 16 soldered thereto is plugged, is first brought into a bearing arrangement with the spring-elastic rail 12 at an angle from above. That is to say that the primary heat sink 18 is pushed in in the direction of the spring rail 12 with its one side, having the clamping edge 22, beneath the latching tab 20 of the lampholder 1, in the manner of a foot being inserted into a shoe, and is then pressed into the accommodating rail 1 by a corresponding pivoting movement counter to the resistance of the opposite (spring-elastic) latching projection 24. The light-emitting means 2, i.e. the primary heat sink 18 including the printed circuit board 14 held thereon, is dismantled correspondingly in the reverse sequence.

Finally, reference is made of the fact that, in accordance with the first preferred exemplary embodiment of the invention, a light-transmissive cover 28 is positioned onto the primary heat sink 18 for protecting the printed circuit board 14 and the LEDs 16 arranged thereon. The cover 28 can in this case be fastened on the primary heat sink 18 either by means of a clip mechanism and/or by screwing.

Figure 5:
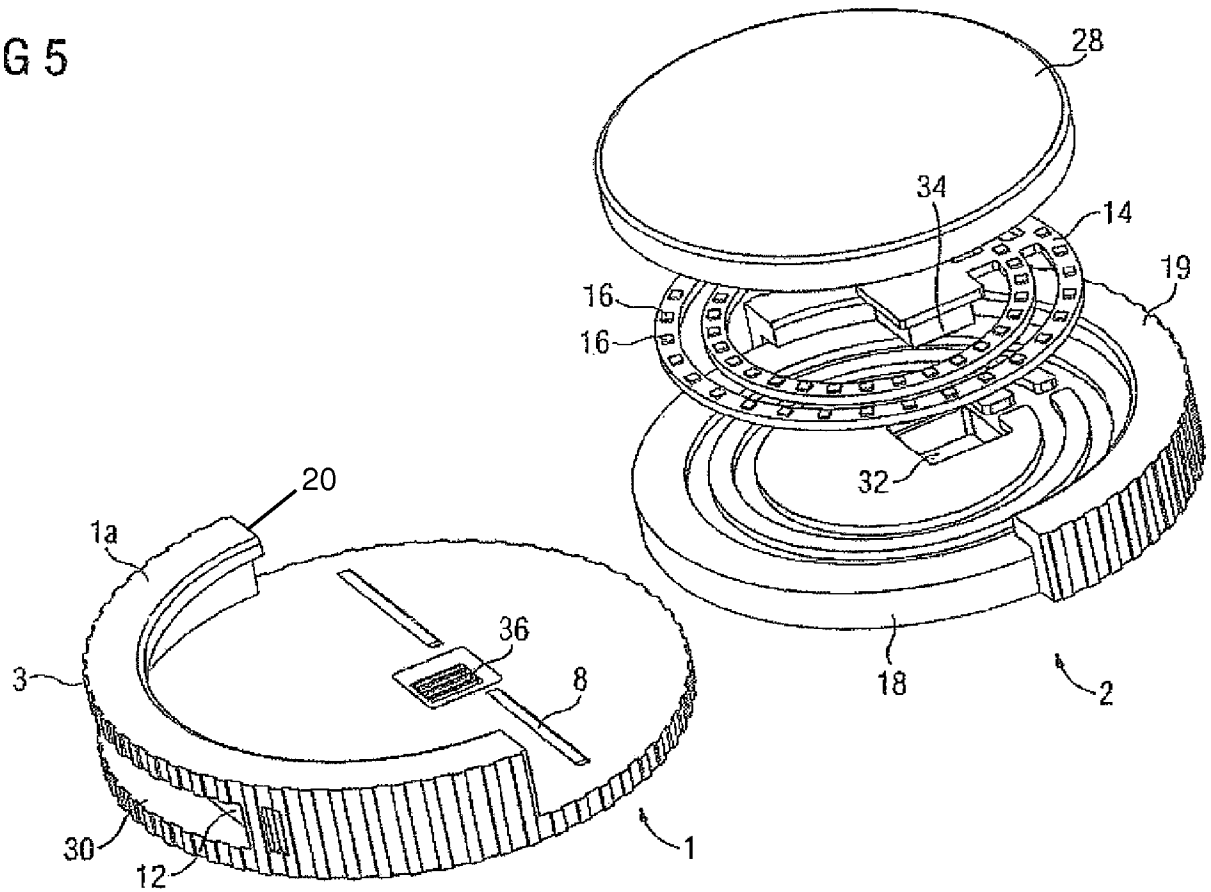
FIG. 5 shows an exploded illustration of an LED lighting device in accordance with a second preferred exemplary embodiment of the invention.

FIG. 5 describes in more detail a second preferred exemplary embodiment of the invention.

Accordingly, the LED lighting device of the second exemplary embodiment likewise comprises a light-emitting means 2 and a lampholder 1, into which the light-emitting means 2 can be inserted using a pretensioning spring 12.

The light-emitting means 2 has, in the present case, a printed circuit board 14 which is in the form of a ring-shaped disk and which is populated with a plurality of LEDs 16, which are spaced apart from one another in the circumferential direction. More specifically, the printed circuit board 14 comprises two ring plates inserted one inside the other, which are electrically connected to one another and which are populated in each case with LEDs.

Furthermore, the light-emitting means 2 has a printed circuit board mount 18, preferably in the form of a primary heat sink, comprising a circular disk, with grooves formed in one circular face thereof, with the configuration of said grooves corresponding to the printed circuit board 14 in the form of a ring-shaped disk. Accordingly, the printed circuit board 14 can be pressed/clipped into/onto the printed circuit board mount 18.

A collar-shaped or web-shaped cooling element 3 is fastened on a peripheral side of the circular plate 18 or formed integrally with the circular plate 18. This cooling element 3 therefore extends substantially perpendicular to the circular plate face accommodating the printed circuit board 14 and over substantially half the circumference of the circular plate 18. The cooling element 3 is ribbed at least on its radial outer side in order to be able to emit thermal energy to the surrounding environment. Finally, a groove is milled out on the radial inner side of the cooling element 3, with it being possible for a protective disk 28 to be inserted into said groove.

In accordance with the second exemplary embodiment of the invention, the lampholder 1 likewise comprises a circular plate element, with a web-shaped projection 1*a* being integrally formed on the circumferential edge thereof. This web-shaped projection 1*a* in this case extends perpendicular to a flat side of the circular plate and substantially over half the circumference of this circular plate. Furthermore, the web-shaped projection 1*a* has, on its radial outer inner side, a groove which has been milled out and which serves to accommodate the protective disk 28.

Finally, the web-shaped projection 1*a* has, in a central section, a slot 30 extending over part of the circumference and into which a spring mechanism 12, preferably in the form of a spring platelet, is inserted, which spring mechanism curves radially inwards. In addition, FIG. 5 also illustrates a coding projection or recess 8, which is formed on a side face of the lampholder circular disk 1 and interacts with a corresponding mating piece on the part of the light-emitting means circular disk. That is to say that, as in the first exemplary embodiment, only a light-emitting means 2 whose coding corresponds to the lampholder coding can be inserted into the lampholder 1 provided with the coding web or recess 8.

The fitting of the LED lighting device in accordance with the second preferred exemplary embodiment of the invention, as is illustrated in FIG. 5, is in this case configured as follows:

First, the printed circuit board 14 in the form of a ring-shaped disk is pressed into the printed circuit board mount 18, in particular into the accommodating grooves formed therein. In this case, as shown in FIG. 5, an aperture 32 or an opening is provided in the printed circuit board mount 18, through which aperture or opening a terminal block 34 of the printed circuit board 14 protrudes when said printed circuit board is fitted.

Then, the printed circuit board mount 18 together with the printed circuit board 14 fastened thereto is fitted to the lampholder 1. For this purpose, the printed circuit board mount 18 is positioned onto the circular disk of the lampholder 1 and moved in the direction towards the web-shaped projection 1*a*. As is illustrated in FIG. 5, a latching tab 20 is formed on the free end side of the web-shaped projection 1*a*, with the circular plate of the printed circuit board mount 18 being pushed beneath said latching tab until said printed circuit board mount comes into contact with the pretensioning spring 12. During this movement, the cooling rib web 3 on the printed circuit board mount 18 is arranged diametrically with respect to the web-shaped projection 1*a* of the lampholder 1 and finally, in the ready-fitted state, forms a closed circumferential heat sink ring around the printed circuit board 14 in the form of a circular ring.

Furthermore, when the printed circuit board mount 18 and the circular disk of the lampholder 1 are pushed one over the other, the protective disk 28 is inserted above the printed circuit board 14, which is ultimately clamped into the grooves formed in the cooling rib web and in the web-shaped projection 1*a*.

Once the sliding movement counter to the spring prestress of the spring element 12 accommodated in the web-shaped projection 1*a* has come to an end, the printed circuit board mount 18 latches with the lampholder 1, preferably at the coding projections/recesses 8, which in the present case represent the abutment for the pretensioning spring 12.

In addition, reference is made to the fact that a cutout 36 is also formed in the circular disk of the lampholder 1, with the contact block 34 of the printed circuit board 14 protruding through said cutout once the fitting process is finished, with the result that the LED lighting device can be electrically connected on the rear side of the lampholder circular plate.

Finally, reference is made to the fact that the LED lighting device according to the invention, with reference to the above-described exemplary embodiments, either has a bar form or a circular form. However, it is also possible to implement forms other than this which function in accordance with the same principle according to the invention, namely the spring-pretensioned holding of the light-emitting means 2, i.e. the printed circuit board 14 with a primary heat sink 18 surrounding said printed circuit board is built into a lampholder 1 which preferably forms a secondary heat sink. To this extent, the lampholder 1 can also be formed with a bayonet closure or screw closure in order to be able to insert said lampholder 1 into already existing conventional lampholders. In the case of the circular lampholder 1 in accordance with the second exemplary embodiment, there is in this case the possibility in particular of a base arranged on the lower side of the lampholder 1, in particular a screw or bayonet base, as is conventional, for example, in general lighting incandescent lamps or in reflector lamps, as a result of which the lighting device could be used as a retrofit for these lamps.

In the case of the bar form in accordance with the first exemplary embodiment, in particular the attachment of a pin base in the region of one or both ends of the lighting device is conceivable, with the result that the LED lighting device can be used as a replacement (retrofit) for a linear discharge lamp, for example a T8 fluorescent lamp. Owing to the use of suitable bases, replacement of a linear incandescent lamp, as is marketed, for example, under the name "Linestra" by OSRAM GmbH, is also conceivable.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. An LED lighting device comprising:

an elongated light-emitting means comprising:

an elongated heat sink mount having a longitudinally extending lateral bearing edge projecting outwardly and extending longitudinally;

an elongated electronic circuit board mounted longitudinally to the elongated heat sink mount; and a plurality of LEDs electrically mounted longitudinally to the elongated electronic circuit board; and an elongated lampholder comprising:

a first elongated flank;

a second elongated flank; and an elongated rail base, wherein a first longitudinal edge of the elongated rail base is connected to a first longitudinal edge of the first elongated flank and wherein a second longitudinal edge of the elongated rail base is connected to a first longitudinal edge of the second elongated flank so that the first and second elongated flanks and the elongated rail base form an elongated U shape, wherein a second longitudinal edge of the first elongated flank has an elongated latching tab projecting inwardly; and an elongated elastic element mounted on the first elongated flank between the elongated latching tab and the elongated rail base, wherein the elongated light-emitting means and the elongated lampholder are shaped so that, when the elongated light emitting means is fully mounted into the elongated lamp holder, the elongated light-emitting means fits into the elongated U shape of the elongated lampholder with the longitudinally extending lateral bearing edge fitting between the elongated latching tab and the elongated rail base and with the elongated elastic element exerting a pre-tensioning force on the elongated heat sink mount of the elongated light-emitting means directed toward the second elongated flank of the elongated lampholder to clamp the elongated light-emitting means between the elongated elastic element and the second elongated flank.

2. The LED lighting device of claim 1, wherein a receptacle for the elongated elastic element is formed in the first elongated flank of the elongated lampholder.

3. The LED lighting device of claim 1, wherein the elongated lampholder comprises a secondary heat sink formed integrally with said elongated lampholder.

4. The LED lighting device of claim 3, wherein the secondary heat sink comprises a plurality of cooling ribs formed in an outer surface of at least one of the elongated flanks.

5. The LED lighting device of claim 1, wherein the elongated light-emitting means further comprises a light-transmissive cover mounted to the elongated heat sink mount so as to enclose the elongated electronic circuit board and the LEDs between the light-transmissive cover and the elongated heat sink mount.

6. An LED lighting device comprising:

a light-emitting means comprising:

a circular heat sink mount disk having a bearing edge projecting circumferentially outwardly, the circular heat sink mount disk having a projection extending from a bottom surface of the circular heat sink mount disk;

a ring-shaped electronic circuit board mounted to a top surface of the circular heat sink mount disk; and a plurality of LEDs electrically mounted in a circle to the ring-shaped electronic circuit board; and a lampholder comprising:

a curved flank; and a circular base plate, wherein a portion of a circumferential edge of the circular base plate is connected to a first edge of the curved flank with the curved flank extending substantially perpendicular from a top surface of the circular base plate, the circular base plate having a recess in the top surface shaped and positioned so as to mate with the projection extending from the bottom surface of the circular heat sink mount disk when the light emitting means is fully mounted into the lamp holder, wherein a second edge of the curved flank has a latching tab projecting radially inwardly; and an elastic element mounted on the curved flank between the latching tab and the top surface of the circular base plate, the elastic element positioned to exert a pre-tensioning force on the bearing edge of the circular heat sink mount disk of the light-emitting means directed toward a center of the circular base plate when the light emitting means is fully mounted into the lamp holder, wherein the light-emitting means and the lampholder are shaped so that the light-emitting means fits into the lampholder with the bearing edge fitting between the latching tab and the top surface of the circular base plate when the light emitting means is fully mounted into the lamp holder.

7. The LED lighting device of claim 6, wherein a plurality of web-shaped projection cooling ribs are formed in a circumferential outer surface of at least one of the curved flank and the circular heat sink mount disk.

8. The LED lighting device of claim 6, wherein the light-emitting means further comprises a light-transmissive cover mounted to the circular heat sink mount disk so as to enclose the ring-shaped electronic circuit board and the LEDs between the light-transmissive cover and the circular heat sink mount disk.

* * * * *